US006866617B2

(12) United States Patent
Chen

(10) Patent No.: US 6,866,617 B2
(45) Date of Patent: Mar. 15, 2005

(54) EXERCISER ASSEMBLY HAVING ADJUSTABLE HANDGRIP

(76) Inventor: Ming Chin Chen, P.O. Box 63-298, Taichung (TW), 406

( * ) Notice: Subject to any disclaimer, the term of this patent is extended or adjusted under 35 U.S.C. 154(b) by 0 days.

(21) Appl. No.: 10/373,324

(22) Filed: Feb. 21, 2003

(65) Prior Publication Data

US 2003/0130099 A1 Jul. 10, 2003

Related U.S. Application Data

(62) Division of application No. 09/888,821, filed on Jun. 22, 2001.

(51) Int. Cl.[7] ..... A68R 21/02
(52) U.S. Cl. ..... 482/124; 482/126
(58) Field of Search ..... 482/121–126, 482/49; D21/691–692

(56) References Cited

U.S. PATENT DOCUMENTS

| | | | | | |
|---|---|---|---|---|---|
| 196,324 | A | * | 10/1877 | Barnett | 482/126 |
| 1,112,114 | A | * | 9/1914 | Caines | 482/129 |
| 1,965,511 | A | * | 7/1934 | Charles | 482/129 |
| 2,930,614 | A | * | 3/1960 | McIntosh | 482/126 |
| 4,109,907 | A | * | 8/1978 | Zito | 482/94 |
| 4,779,867 | A | * | 10/1988 | Hinds | 482/126 |
| 5,505,677 | A | * | 4/1996 | Hinds | 482/10 |
| 5,549,532 | A | * | 8/1996 | Kropp | 482/126 |
| 5,681,248 | A | * | 10/1997 | Vani | 482/126 |
| 5,746,687 | A | | 5/1998 | Vial et al. | 482/126 |
| 5,894,631 | A | * | 4/1999 | Chiu | 16/443 |
| 6,398,698 | B1 | | 6/2002 | Hinds | 482/126 |

* cited by examiner

*Primary Examiner*—Jerome W. Donnelly
*Assistant Examiner*—Fenn C Mathew

(57) ABSTRACT

An exerciser device includes two handles each having a hole to receive ends of a cable, and two impringer heads engageable into the holes of the handles and engaged with the ends of the cable, to force the ends of the cable against the handles, and to secure the ends of the cable to the handles. The impringer heads each includes an outer peripheral portion having one or more peripheral grooves to form two or more contact points with the cable, and to solidly and detachably secure the cable to the handles. The impringer heads may be detachably secured to the handles with wires.

15 Claims, 6 Drawing Sheets

EXERCISER ASSEMBLY HAVING ADJUSTABLE HANDGRIP

The present invention is a divisional application of U.S. patent application Ser. No. 09/888,821, filed on Jun. 22, 2001, pending.

BACKGROUND OF THE INVENTION

1. Field of the Invention

The present invention relates to an exerciser assembly, and more particularly to an exerciser assembly including adjustable handgrip.

2. Description of the Prior Art

Typical exerciser assemblies have been developed for conducting multi-purpose exercises. For example, U.S. Pat. No. 5,746,687 to Vial et al. discloses one of the typical exerciser assemblies having two handles to be attached or secured to the ends of an elastic flexible line or cable. However, a complicated securing device or assembly is required for securing the elastic flexible cable to the handles.

U.S. Pat. No. 6,398,698 to Hinds discloses another exerciser having adjustable handgrip assembly. The adjustable handgrip assembly of the exerciser comprises an elastic member, such as elastic exercise cord, elastic exercise sheet, or elastic exercise strap to be attached to one or more handgrips with impringer heads. The impringer heads include spherical, lozenge shape, truncated sphere, ovate and bean shape, etc. Both the elastic member and the impringer head will be engaged in the member channel of the nest of the handgrip, and the impringer head may latch or force the elastic member against the nest of the handgrip.

However, the impringer heads include a smooth outer contour or smooth outer peripheral surface and may not be solidly contacted or engaged with the elastic member, such that the elastic member may not be solidly or effected forced against the nest of the handgrip.

The present invention has arisen to mitigate and/or obviate the afore-described disadvantages of the conventional exerciser assemblies.

SUMMARY OF THE INVENTION

The primary objective of the present invention is to provide an exerciser assembly including an improved impringer head to solidly or effectively latch or force the elastic member against the nest of the handgrip, and thus for solidly securing the elastic member to the handgrip.

In accordance with one aspect of the invention, there is provided an exerciser assembly comprising a cable including two ends, two handles each including a hole formed therein to receive the ends of the cable respectively, and two impringer heads engageable into the holes of the handles respectively, and engaged with the ends of the cable respectively, to force the ends of the cable against the handles respectively, and to secure the ends of the cable to the handles respectively. The impringer heads each includes an outer peripheral portion having at least one peripheral groove formed therein, to form at least two contact points between the cable and each of the impringer heads.

Each of the impringer heads includes a semi-spherical end portion to facilitate an engagement of the impringer heads into the holes of the handles respectively, and an engagement with the ends of the cable respectively.

Two wires are further provided and each has a first end secured to the impringer heads respectively, and each has a second end, and two locks secured to the second ends of the wires respectively, and engageable with the wires to lock the impringer heads to the handles respectively. Each of the locks includes an L-shaped lock notch formed therein to receive the wires respectively, and to lock the wires and the impringer heads to the handles respectively.

Each of the handles includes a U-shape having two ends, a tube is secured between the ends of the handle, and two rods are further provided and secured to the tubes of the handles respectively.

Each of the ends of the handles includes an extension extended therefrom and having a peripheral rib extended therefrom to engage with and to lock the ends of the handles to the tubes respectively.

Two caps may further be provided and secured to the rods respectively, and two poles may be secured between the caps and the tubes of the handles respectively. A flexible and longitudinal member may further be provided and includes two ends secured to the rods respectively.

Two couplers may be secured between the ends of the longitudinal member and the rods respectively. The couplers each includes a first end having a shank extended therefrom and engaged into the ends of the longitudinal member respectively, and each includes a second end having a screw hole formed therein, the rods each includes a fastener extended therefrom and threaded with the screw holes of the couplers respectively.

One or more foot supports may further be provided and attached onto the cable. The foot support includes a bottom portion having a sleeve provided thereon to receive the cable.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
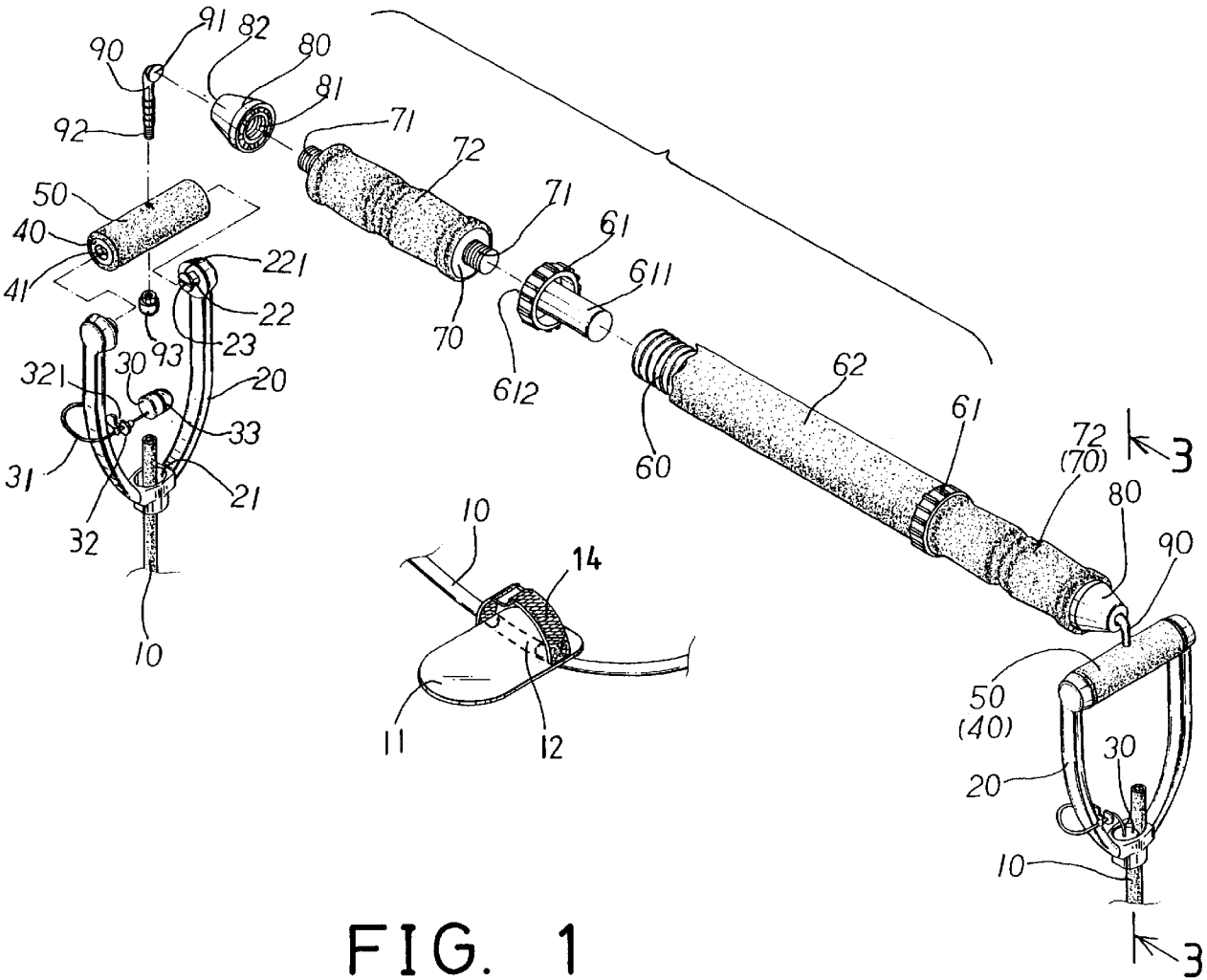
FIG. 1 is a partial exploded view of an exerciser assembly in accordance with the present invention.
Figure 2:
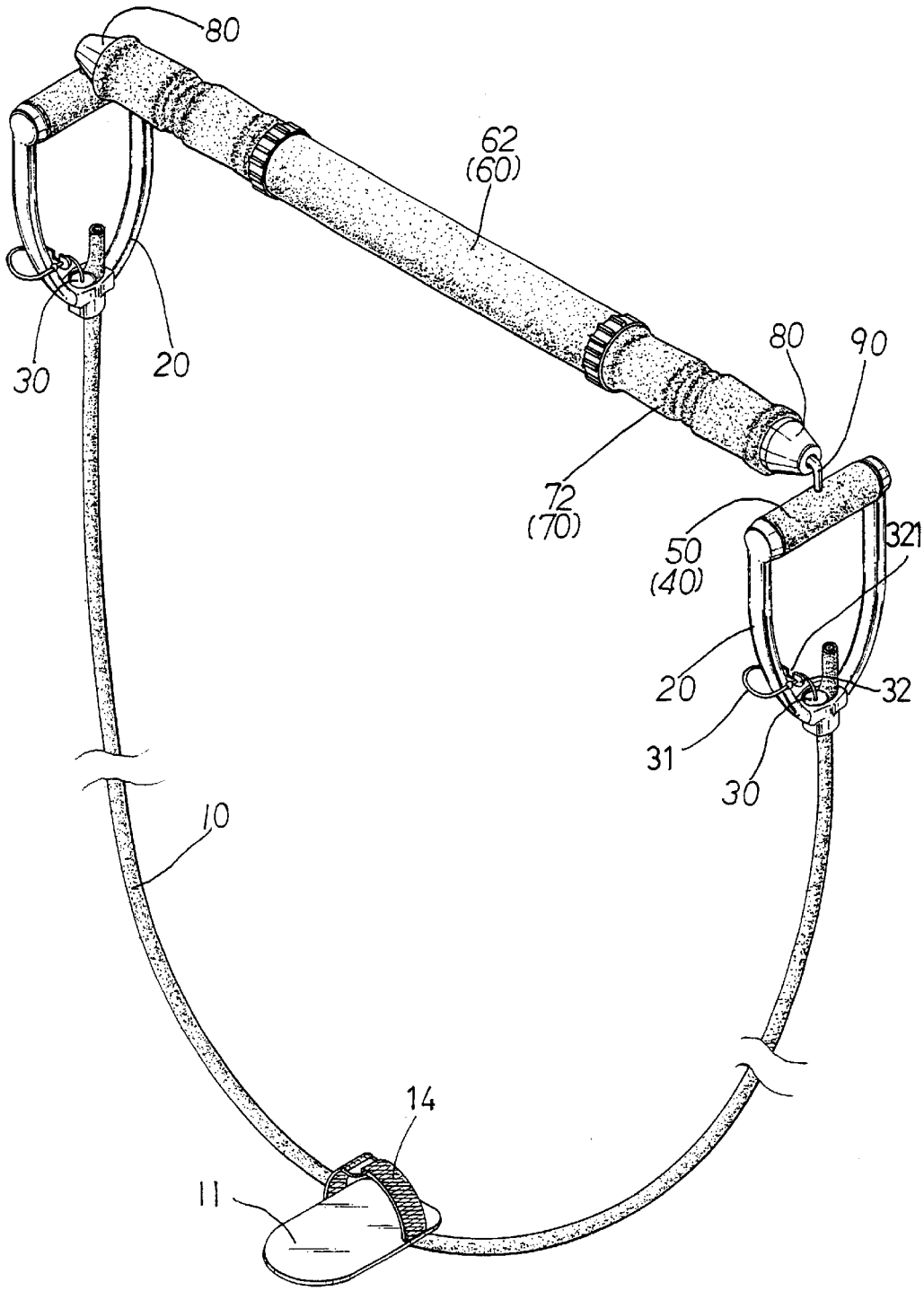
FIG. 2 is a perspective view of the exerciser assembly.
Figure 4:
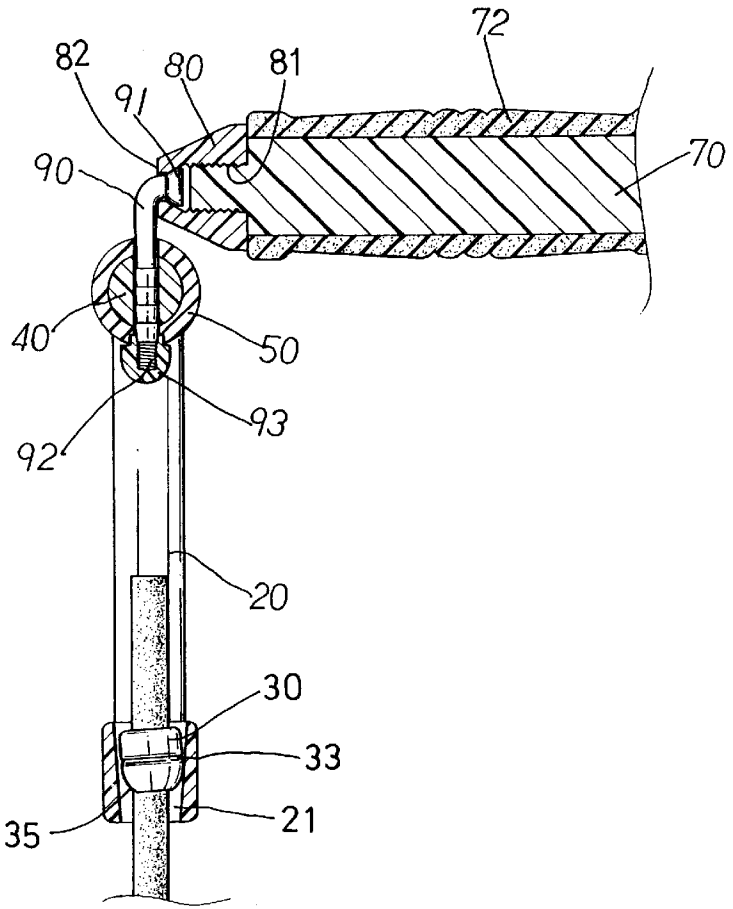
FIG. 4 is a partial cross sectional view taken along lines 4—4 of FIG. 3.

Referring to the drawings, and initially to FIGS. 1–4, an exerciser assembly in accordance with the present invention comprises a longitudinal or resilient or flexible cable 10 including two ends for securing to two handles 20 respectively. One or more foot supports 11 may each include a sleeve, such as a woven sleeve 12 secured or stitched to the bottom thereof for receiving the cable 10, and for attaching the foot supports 11 onto the cable 10.

The foot supports 11 each may include a strap 14 attached thereon for engaging with the foot of the user, and for allowing the user to wear the foot supports 11. In operation, the users may wear the foot supports 11 and may use their feet to position the middle or bottom portion of the cable 10, and may then use their hands to pull or stretch the cable 10, in order to conduct various kinds of pulling or stretching exercises.

The handles 20 each includes a U-shape having two upper ends, and a hole 21 formed in the bottom portion thereof for receiving the end portions of the cable 10. Two stops or impringer heads 30 may be engaged into the holes 21 of the handles 20 respectively, and may be engaged with the end portions of the cable 10, for forcing the end portions of the cable 10 against the handles 20, in order to detachably secure the end portions of the cable 10 to the handles 20.

The impringer heads 30 preferably include a cylindrical shape having a reduced or substantially semi-spherical end portion 34 for allowing the impringer heads 30 to easily engage into the holes 21 of the handles 20 from the semi-spherical end portion 34 thereof, and for allowing the impringer heads 30 to easily engage onto the end portions of the cable 10, and to force the end portions of the cable 10 against the handles 20, and thus to easily and detachably secure the cable 10 to the handles 20.

Each of the impringer heads 30 preferably includes one or more peripheral grooves 33 formed around the cylindrical outer peripheral portion thereof in order to form two or more contact points 34, 36 (FIG. 3) on the outer peripheral portion of the impringer head 30, which may be contacted or engaged with the cable 10, in order to further solidly secure the cable 10 to the handles 20.

A wire 31 has one end secured to each of the impringer heads 30 and has a lock 32 secured to the other end thereof. The lock 32 has a lock notch, such as an L-shaped lock notch 321 formed therein for engaging with the wire 31, and for detachably securing the wire 31 to the handle 20, and for detachably securing the impringer head 30 to the handle 20.

Figure 3:
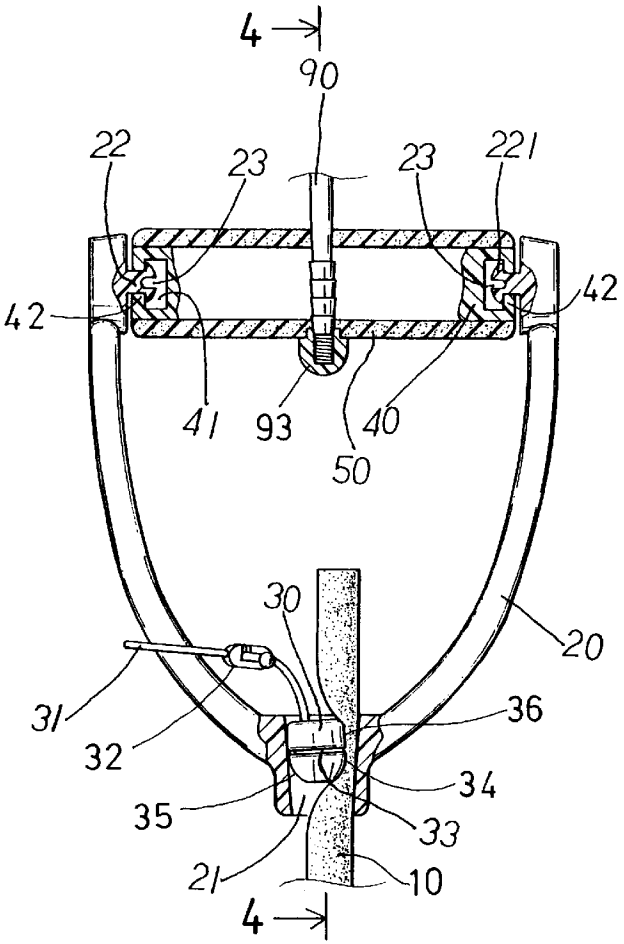
FIG. 3 is a partial cross sectional view taken along lines 3—3 of FIG. 1.
Figure 5:
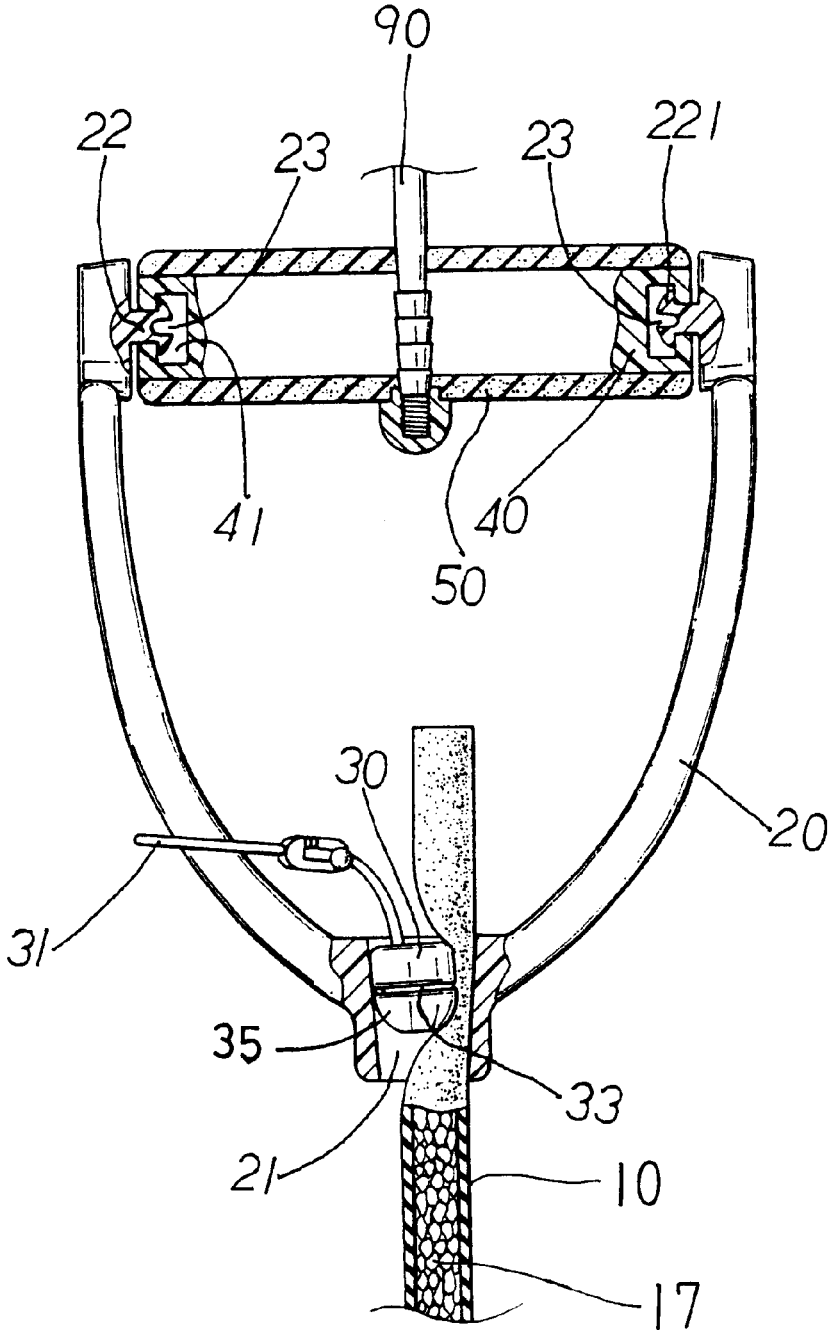
FIG. 5 is a partial cross sectional view similar to FIG. 3, illustrating the other arrangement of the exerciser assembly.

As shown in FIGS. 1, 3, 5, the handles 20 each includes two upper ends each having an extension 22 extended therefrom and each having a peripheral rib 221 and a slit 23 formed in the extension 22 respectively. A tube 40 is disposed between the upper ends of each of the handles 20, and includes two ends each having a cavity 41 formed therein for receiving the respective extensions 22 of the handle 20.

As best shown in FIG. 3, the tube 40 includes a peripheral flange 42 extended inward of the cavity 41 thereof from each of the ends thereof, for engaging with the peripheral rib 221 of the extension 22, and for locking or securing the tube 40 between the upper ends of the handle 20. A resilient or soft covering 50 may be engaged onto each of the tubes 40, for allowing the users to comfortably hold or grasp the tubes 40.

A resilient or flexible and longitudinal member 60 may further be provided and may be formed by such as a conical or coil spring, as shown in FIG. 1. Two couplers 61 each may include a shank 611 extended therefrom and engaged into the ends of the longitudinal member 60 respectively with such as a force-fitted engagement, or adhesive materials, or by welding processes, etc.

The couplers 61 each may include a screw hole 612 formed therein for threading with a bolt or fastener 71 of a rod 70 respectively. Two rods 70 may thus be secured to the ends of the longitudinal member 60 respectively with the couplers 61 and the fasteners 71, and each may include two ends each having a fastener 71 secured thereto. The rods 70 are preferably made of heavier materials, such as metal, for increasing the weight of the ends of the longitudinal member 60.

In operation, the users may have one or both of their hands holding or grasping the longitudinal members 60, and may wave or vibrate the longitudinal members 60 for conducting rhythmic exercises. The users may hold the rods 70, and may bend the longitudinal member 60, in order to train the upper muscle groups. The rods 70 may also be used as the typical dumbbells, or may be disengaged from the longitudinal member 60, and may be used as the handgrips for conducting rope skipping exercises.

Two caps 80 may each include a screw hole 81 formed in one end thereof for threading with the fasteners 71 of the rods 70, and for securing to the ends or other ends of the rods 70 respectively. The caps 80 each may include a peripheral flange 82 extended radially inward from the other end thereof. A number of weighted particles 17 (FIG. 5) may further be provided and engaged into the cable 10 in order to increase the weight of the cable 10.

Two poles 90 are engaged through the caps 80 respectively, and each may include an enlarged head 91 formed on one end thereof for engaging with the peripheral flanges 82 of the caps 80, and for securing to the caps 80 respectively. The poles 90 each may have the other end thereof engaged through the respective tubes 40 and secured to the tubes 40 with lock nuts 93 respectively, for securing the caps 80 and thus the rods 70 and the ends of the longitudinal member 60 to the handles 20 respectively.

Figure 6:
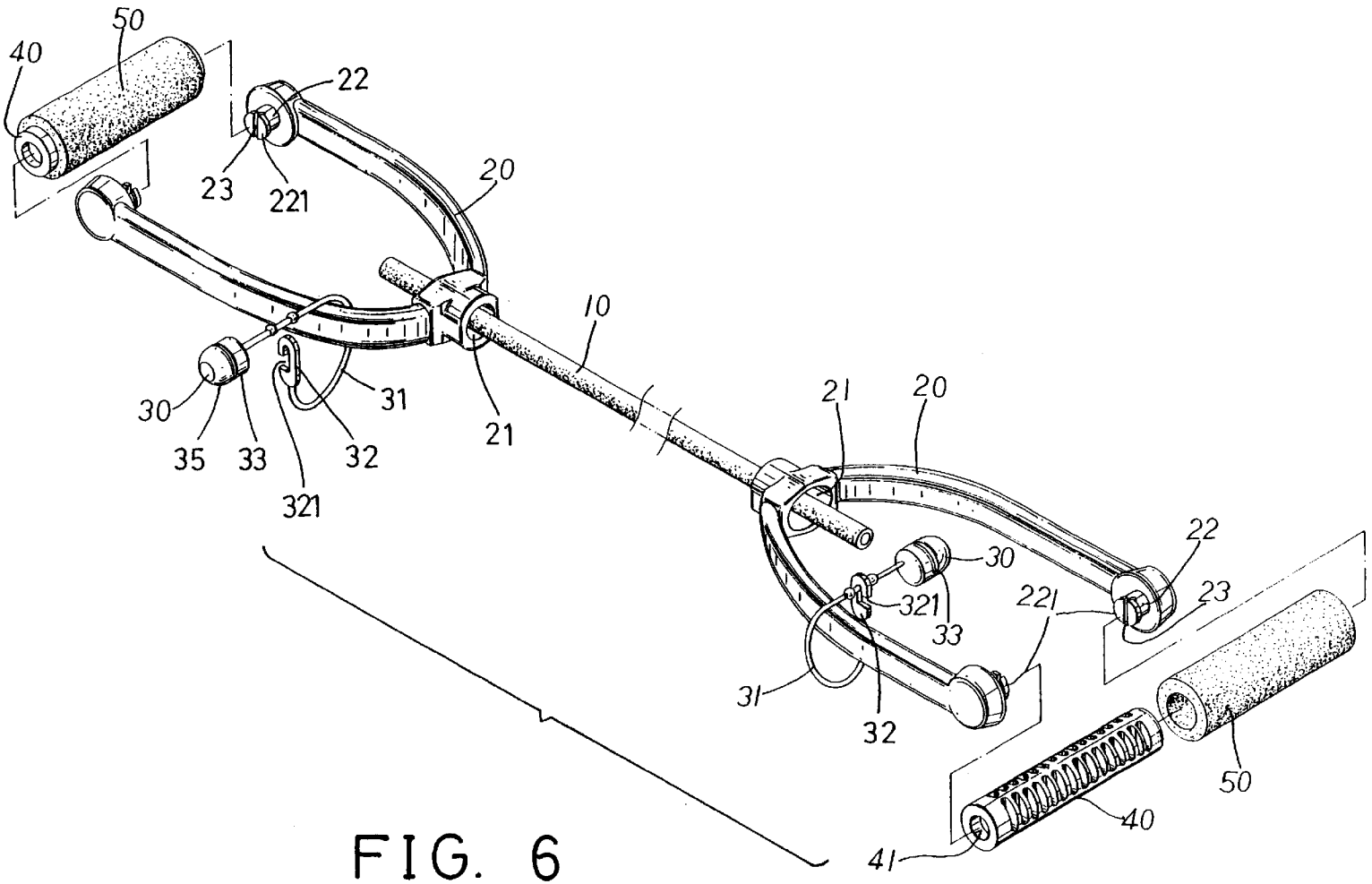
FIG. 6 is a partial exploded view illustrating another arrangement of the exerciser assembly.
Figure 7:
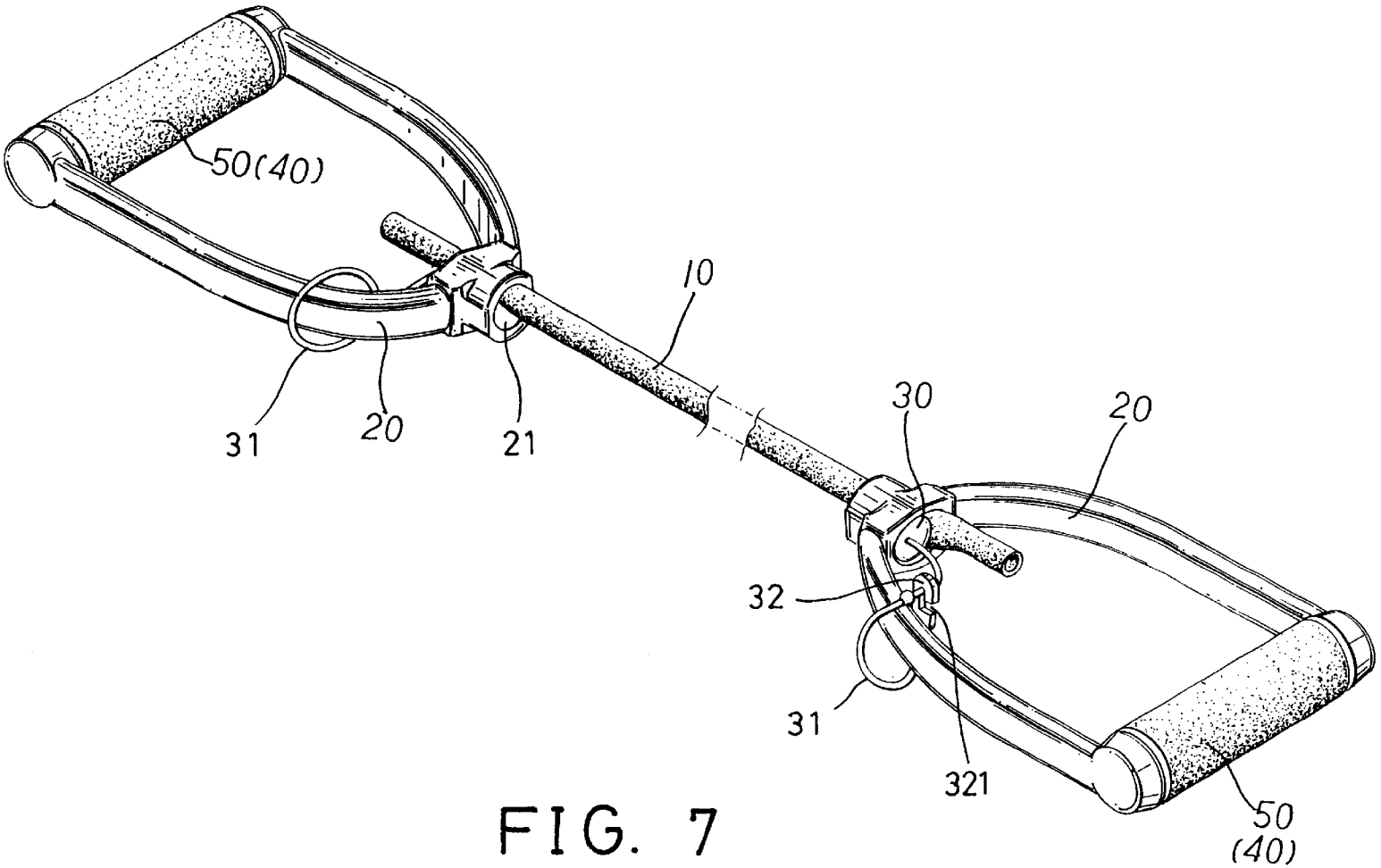
FIG. 7 is a perspective view of the arrangement of the exerciser assembly as shown in FIG. 6.

As shown in FIGS. 6 and 7, the cable 10 may only be disposed between the handles 20, and easily and quickly and detachably secured to the handles 20 with the impringer heads 30. The impringer heads 30 may be detachably coupled or retained to the handles 20 respectively with the wire 31 and the lock 32, and will not be easily disengaged from the handles 20.

Accordingly, the exerciser assembly in accordance with the present invention includes an improved impringer head to solidly or effectively latch or force the elastic member against the nest of the handgrip, and thus for solidly securing the elastic member to the handgrip.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser assembly comprising:

a handle including a hole formed therein, a cable including a first end engaged into said hole of said handle, and an impringer head engageable into said hole of said handle, and engaged with said first end of said cable, to force said first end of said cable against said handle, and to secure said first end of said cable to said handle, wherein said impringer head includes an outer peripheral portion having at least one peripheral groove formed therein, to form at least two contact points between said cable and said impringer head.

2. The exerciser assembly as claimed in claim 1, wherein said impringer head includes a semi-spherical end portion to facilitate an engagement of said impringer head into said hole of said handle and an engagement with said first end of said cable.

3. The exerciser assembly as claimed in claim 1 further comprising a wire having a first end secured to said impringer head, and a second end, and a lock secured to said second end of said wire and engageable with said wire to lock said impringer head to said handle.

4. The exerciser assembly as claimed in claim 3, wherein said lock includes an L-shaped lock notch formed therein to receive said wire, and to lock said wire and said impringer head to said handle.

5. An exerciser assembly comprising:

a cable including two ends, two handles each including a hole formed therein to receive said ends of said cable respectively, and two impringer heads engageable into said holes of said handles respectively, and engaged with said ends of said cable respectively, to force said ends of said cable against said handles respectively, and to secure said ends of said cable to said handles respectively, wherein said impringer heads each includes an outer peripheral portion having at least one peripheral groove formed therein, to form at least two contact points between said cable and each of said impringer heads.

6. The exerciser assembly as claimed in claim 5, wherein each of said impringer heads includes a semi-spherical end portion to facilitate an engagement of said impringer heads into said holes of said handles respectively, and an engagement with said ends of said cable respectively.

7. The exerciser assembly as claimed in claim 5 further comprising two wires each having a first end secured to said impringer heads respectively, and each having a second end, and two locks secured to said second ends of said wires respectively, and engageable with said wires to lock said impringer heads to said handles respectively.

8. The exerciser assembly as claimed in claim 7, wherein each of said locks includes an L-shaped lock notch formed therein to receive said wires respectively, and to lock said wires and said impringer heads to said handles respectively.

9. The exerciser assembly as claimed in claim 5, wherein each of said handles includes a U-shape having two ends, a tube secured between said ends of said handle, and said exerciser assembly further includes two rods secured to said tubes of said handles respectively.

10. The exerciser assembly as claimed in claim 9, wherein each of said ends of said handles includes an extension extended therefrom and having a peripheral rib extended therefrom to engage with and to lock said ends of said handles to said tubes respectively.

11. The exerciser assembly as claimed in claim 10 further comprising two caps secured to said rods, and two poles secured between said caps and said tubes of said handles respectively.

12. The exerciser assembly as claimed in claim 9 further copprising a flexible and longitudinal member including two ends secured to said rods respectively.

13. The exerciser assembly as claimed in claim 12 further comprising two couplers secured between said ends of said longitudinal member and said rods respectively.

14. The exerciser assembly as claimed in claim 13, wherein said couplers each includes a first end having a shank extended therefrom and engaged into said ends of said longitudinal member, and each includes a second end having a screw hole formed therein, said rods each includes a fastener extended therefrom and threaded with said screw holes of said couplers respectively.

15. The exerciser assembly as claimed in claim 5 further comprising at least one foot support attached onto said cable, and including a bottom portion having a sleeve provided thereon to receive said cable.

* * * * *